US009874845B2

(12) United States Patent
Baba

(10) Patent No.: US 9,874,845 B2
(45) Date of Patent: Jan. 23, 2018

(54) IMAGE FORMING APPARATUS, METHOD AND NON-TRANSITORY COMPUTER READABLE MEDIUM STORING PROGRAM

(71) Applicant: FUJI XEROX CO., LTD., Tokyo (JP)

(72) Inventor: Toshiaki Baba, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/257,648

(22) Filed: Sep. 6, 2016

(65) Prior Publication Data

US 2017/0277106 A1 Sep. 28, 2017

(30) Foreign Application Priority Data

Mar. 25, 2016 (JP) ..... 2016-062374
Aug. 17, 2016 (JP) ..... 2016-160036

(51) Int. Cl.
*G03G 15/08* (2006.01)
*G03G 15/00* (2006.01)

(52) U.S. Cl.
CPC ..... *G03G 15/6582* (2013.01); *G03G 15/0877* (2013.01); *G03G 2215/00801* (2013.01)

(58) Field of Classification Search
None
See application file for complete search history.

(56) References Cited

U.S. PATENT DOCUMENTS 5,113,221 A 5/1992 Kotani et al.
2004/0038056 A1* 2/2004 Song ..... B41M 5/52 428/500
2015/0029518 A1* 1/2015 Tashiro ..... G03G 15/5025 358/1.1

FOREIGN PATENT DOCUMENTS

JP H01-109368 A 4/1989

* cited by examiner

*Primary Examiner* — Thomas Giampaolo, II
(74) *Attorney, Agent, or Firm* — Oliff PLC

(57) ABSTRACT

An image forming apparatus is provided with a setting unit that sets a white toner amount per unit area corresponding to lightness of a recording medium that forms a white image using white toner, and an image forming unit that forms a white image using a white toner amount per unit area which is set by the setting unit and forms a color image using colored toner.

10 Claims, 11 Drawing Sheets

| TRAY | SHEET TYPE | SHEET SIZE | SHEET COLOR | LIGHTNESS OF SHEET (L* VALUE) |
|---|---|---|---|---|
| TRAY 1 | PLAIN PAPER | A4 | WHITE | 90 < |
| TRAY 2 | RECYCLED PAPER | A4 | BROWN | 20 |

IMAGE FORMING APPARATUS, METHOD AND NON-TRANSITORY COMPUTER READABLE MEDIUM STORING PROGRAM

CROSS-REFERENCE TO RELATED APPLICATIONS

This application is based on and claims priority under 35 USC 119 from Japanese Patent Application Nos. 2016-062374 filed Mar. 25, 2016 and 2016-160036 filed Aug. 17, 2016.

BACKGROUND

Technical Field

The present invention relates to an image forming apparatus.

SUMMARY

According to an aspect of the invention, an image forming apparatus is provided with a setting unit that sets a white toner amount per unit area corresponding to lightness of a recording medium on which a white image is formed using white toner, and an image forming unit that forms the white image using the white toner amount per unit area which is set by the setting unit and forms a color image using colored toner.

BRIEF DESCRIPTION OF THE DRAWINGS

Exemplary embodiments of the present invention will be described in detail based on the following figures, wherein.

DETAILED DESCRIPTION

Hereinafter, an example of an exemplary embodiment of the invention will be described in detail with reference to drawings.

<Image Forming Apparatus>

Figure 1:
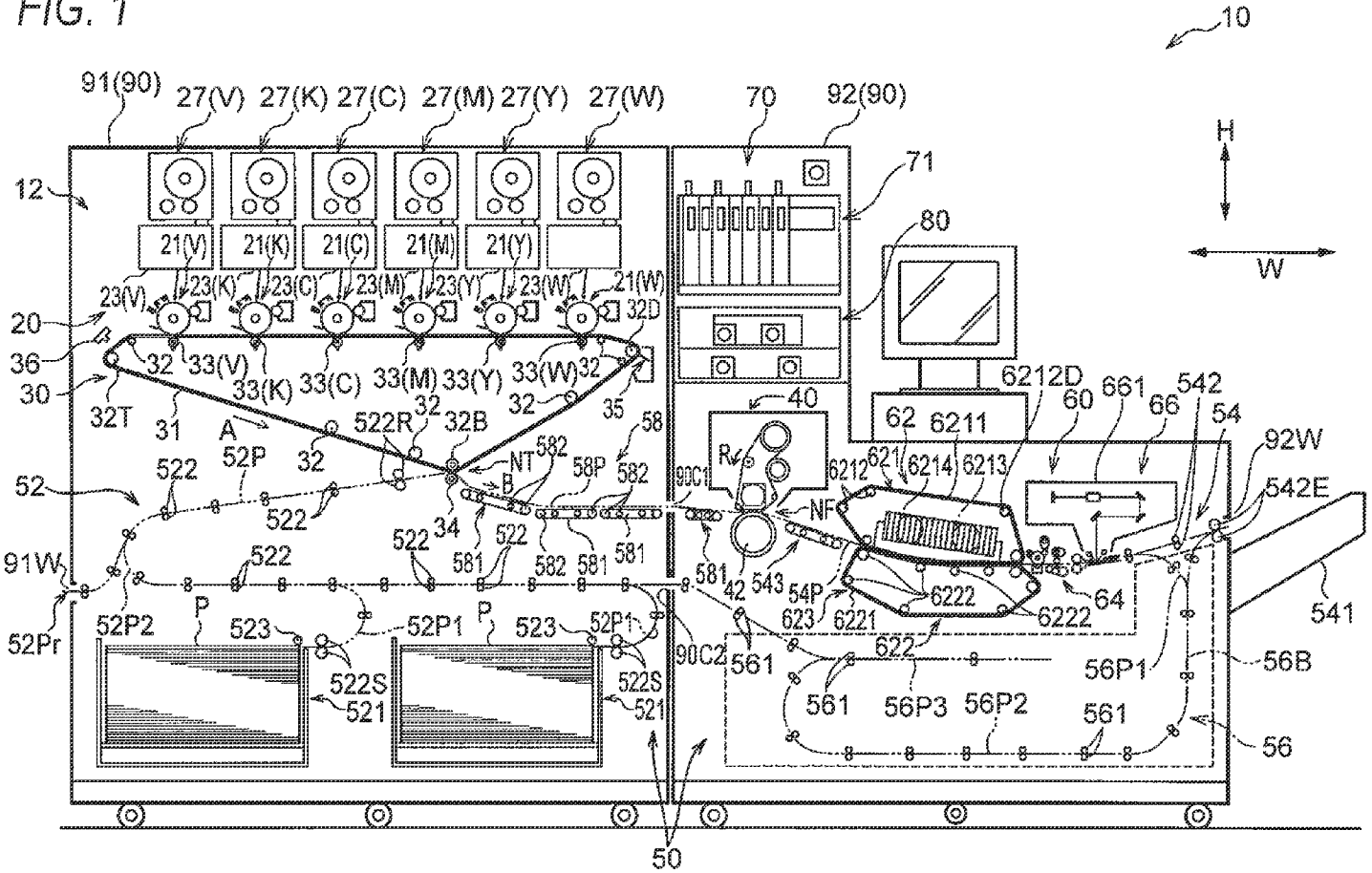
FIG. 1 is a schematic diagram which illustrates an example of a configuration of an image forming apparatus according to a first exemplary embodiment of the invention.
Figure 2:
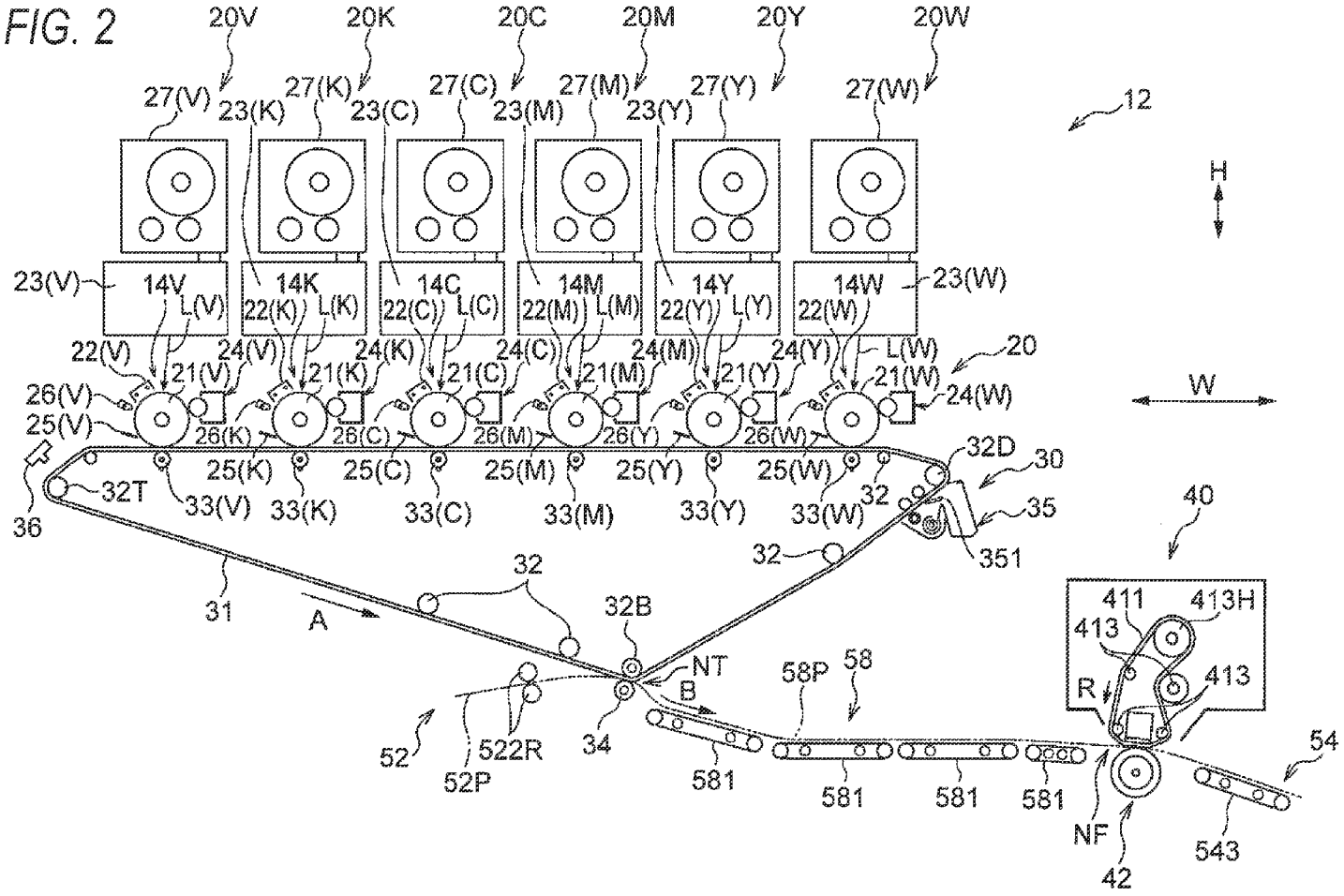
FIG. 2 is a schematic configuration diagram which illustrates a configuration of an image forming unit (main portion) of the image forming apparatus illustrated in FIG. 1.

First, an image forming apparatus will be described. FIG. 1 is a schematic configuration diagram which illustrates an example of a configuration of an image forming apparatus according to an exemplary embodiment of the invention. FIG. 2 is a schematic configuration diagram which illustrates a configuration of an image forming unit (main portion) of the image forming apparatus illustrated in FIG. 1. In addition, an arrow H illustrated in each figure denotes a vertical direction, and an arrow W denotes a horizontal direction, and an apparatus width direction.

As illustrated in FIG. 1, an image forming apparatus 10 is provided with an image forming unit 12 that forms an image on a recording medium P as a recording medium using an electrophotographic system, a medium transport device 50 that transports the recording medium P, and a post-processing unit 60 which performs post-processing, or the like, with respect to the recording medium P on which an image is formed. The image forming apparatus 10 further includes a power supply unit 80 that supplies power to each unit of the apparatus, and a controller 70 which controls each unit of the apparatus.

The image forming unit 12 is provided with a toner image forming unit 20 that forms a toner image, a transfer unit 30 which transfers the toner image formed in the toner image forming unit 20 to the recording medium P, and a fixing unit 40 that fixes the toner image which is transferred to the recording medium P onto the recording medium P.

The medium transport device 50 is provided with a medium supply unit 52 that supplies the medium recording medium P to the image forming unit 12, and a medium output unit 54 that outputs the recording medium P on which a toner image is formed. The medium transport device 50 is further provided with a medium returning unit 56 which is used when forming an image on both faces of the recording medium P, and an intermediate transport unit 58.

The post-processing unit 60 is provided with a medium cooling unit 62 which cools the recording medium P onto which a toner image is transferred in the image forming unit 12, a correcting unit 64 that corrects bending of the recording medium P, and an image inspection unit 66 that inspects the image formed on the recording medium P. Each unit which configures the post-processing unit 60 is disposed in the medium output unit 54 of the medium transport device 50.

In the image forming apparatus 10, each unit except for an output medium receiving unit 541 is accommodated in a housing 90. The housing 90 in the exemplary embodiment has a structure of being divided into two of a first housing 91 and a second housing 92 which are adjacent to each other in the apparatus width direction. In this manner, a unit of transport of the image forming apparatus 10 is set to be small in the apparatus width direction.

In the first housing 91, main portions of the image forming unit 12 except for the fixing unit 40, and the medium supply unit 52 are accommodated. The medium output unit 54, the medium cooling unit 62, the image inspection unit 66, the medium returning unit 56, the controller 70, the power supply unit 80 and the fixing unit 40 that configures the image forming unit 12, are accommodated in the second housing 92.

The first housing 91 and the second housing 92 are jointed, using a fastening unit such as a bolt, a nut, and the like (not illustrated). In this jointed state, a connecting opening portion 90C1 of the recording medium P from a transfer nip NT to a fixing nip NF of the image forming unit 12, and a connecting path 90C2 of the recording medium P from the medium returning unit 56 to the medium supply unit 52 are formed between the first housing 91 and the second housing 92.

(Image Forming Unit)

Here, the "image forming unit" will be described in detail.

The image forming unit 12 is provided with the toner image forming unit 20, the transfer unit 30, and the fixing unit 40. In the exemplary embodiment, toner image forming units 20V, 20W, 20Y, 20M, 20C, and 20K that form a toner image of each color of a first spot color (V), a second spot color (W), a yellow (Y) color, a magenta (M) color, a cyan (C) color, and a black (K) color are provided.

The toner image forming units 20V, 20W, 20Y, 20M, 20C, and 20K are disposed in order of the toner image forming units 20W→20Y→20M→20C→20K→20V from the upstream side of the transfer belt 31 in a movement direction, along an upper side portion of the transfer belt 31. That is, toner images are formed in order of a W color→a Y color→an M color→a C color→a K color→a V color on the transfer belt 31.

In the exemplary embodiment, the first spot color (V) is a white color, and the toner image forming unit 20V forms a toner image using white toner. Hereinafter, the V color can be changed to a "white color". Meanwhile, the second spot color (W) is a user-specific corporate color which is frequently used compared to other colors. In addition, a detail of the white toner, and a control, or the like, of each unit using the controller 70 when forming an image on a recording medium using the white toner will be described later.

Each of the toner image forming units 20V, 20W, 20Y, 20M, 20C, and 20K is similarly configured. In a case in which it is not necessary to classify the units into each color, it is generically referred to as the toner image forming unit 20. As illustrated in FIG. 2, the toner image forming unit 20 is provided with an image forming unit 14, and a toner cartridge 27 that holds toner. The image forming unit 14 of each color is also described without being classified into each color. The image forming unit 14 is provided with a photoconductor drum 21 as an example of an image carrier, a charging unit 22, an exposure unit 23, a developing unit 24 as an example of a developing device, a cleaning unit 25, and a charge eliminating unit 26.

A photoconductive layer is formed on the surface of the photoconductor drum 21. The charging unit 22 charges the surface (photoconductive layer) of the photoconductor drum 21 using corona discharge, or the like, for example. The exposure unit 23 forms an electrostatic latent image on the surface of the photoconductor drum 21, by radiating exposure light L to the surface of the photoconductor drum 21 which is charged by the charging unit 22. The exposure light L is modulated according to image data which is received from an image signal processing unit 71 (refer to FIG. 1) of the controller 70. The developing unit 24 forms a toner image on the surface of the photoconductor drum 21 by developing the electrostatic latent image which is formed on the surface of the photoconductor drum 21 using a developer G containing toner.

The cleaning unit 25 is formed in a blade shape, and scrapes up toner remained on the surface of the photoconductor drum 21 after transferring of the toner image onto the transfer unit 30, from the surface of the photoconductor drum 21. The charge eliminating unit 26 performs eliminating of charge by radiating light to the photoconductor drum 21 after performing transferring. In this manner, charging history on the surface of the photoconductor drum 21 is canceled. The toner cartridge 27 supplies toner to the developing unit 24.

The transfer unit 30 primarily transfers a toner image of each color of the photoconductor drum 21 to the transfer belt 31 by superimposing thereof, and secondarily transfer the superimposed toner image to the recording medium P. Hereinafter, the process will be described in detail.

The transfer belt 31 is formed in an endless shape, and is wound around plural rolls 32, as illustrated in FIG. 2. A roll 32D functions as a driving roll that causes the transfer belt 31 to circulate in the arrow A direction using power of a motor (not illustrated). In addition, a roll 32T functions as a tension applying roll that applies a tension to the transfer belt 31. An apex portion on the lower end side of the transfer belt 31 that forms an obtuse angle is wound around a roll 32B. The roll 32B functions as a facing roll of a secondary transfer roll 34 that will be described later. The transfer belt 31 is in contact with the photoconductor drum 21 of each color from below, at an upper side portion which extends in the apparatus width direction.

A primary transfer roll 33 as an example of a transfer member that transfers a toner image of each photoconductor drum 21 to the transfer belt 31 is disposed in the inside of the transfer belt 31. Each primary transfer roll 33 is disposed so as to face a photoconductor drum 21 of a corresponding color by interposing the transfer belt 31 therebetween. In addition, a transfer bias voltage with a polarity opposite to a polarity of toner is applied to the primary transfer roll 33. Due to the application of the transfer bias voltage, a toner image which is formed on the photoconductor drum 21 is transferred to the transfer belt 31.

The transfer unit 30 is provided with the secondary transfer roll 34 that transfers the toner image which is superimposed onto the transfer belt 31 to the recording medium P. The secondary transfer roll 34 is disposed so as to interpose the transfer belt 31 between the secondary transfer roll and the roll 32B, and a transfer nip NT is formed between the secondary transfer roll and the transfer belt 31. The recording medium P is supplied to the transfer nip NT from the medium supply unit 52 at an appropriate time. A transfer bias voltage with a polarity opposite to a polarity of the toner is applied to the secondary transfer roll 34 using the power supply unit (not illustrated). By applying the transfer bias voltage, a toner image is transferred to the recording medium P that passes through the transfer nip NT, from the transfer belt 31.

In addition, the transfer unit 30 is provided with a cleaning unit 35 that cleans the transfer belt 31 after the secondary transfer. The cleaning unit 35 is disposed on the downstream side of a portion at which the secondary transfer is performed (transfer nip NT), and on the upstream side of a portion at which the primary transfer is performed, in a circulating direction of the transfer belt 31. The cleaning unit 35 includes a blade 351, and scrapes up toner remained on the surface of the transfer belt 31 from the surface of the transfer belt 31.

The fixing unit 40 fixes a toner image onto the recording medium P on which the toner image is transferred in the transfer unit 30. In the exemplary embodiment, the fixing unit 40 fixes a toner image onto the recording medium P, by pressurizing the toner image while heating thereof in the fixing nip NF formed between a fixing belt 411 which is wound around plural rolls 413 and a pressure roll 42.

A roll 413H includes a heater, for example, in the inside, and is set to a heating roll that rotates due to a driving force transmitted from a motor (not illustrated). Due to this, a fixing belt 411 circulates in an arrow R direction. In addition, the pressure roll 42 also rotates at a circumferential speed which is similar to that of the fixing belt 411, due to a driving force which is transmitted from a motor (not illustrated).

(Medium Transport Device)

Here, the "medium transport device" will be described in detail.

The medium transport device 50 includes the medium supply unit 52, the medium output unit 54, the medium returning unit 56, and the intermediate transport unit 58.

The medium supply unit 52 is provided with a tray 521 in which the recording medium P is accommodated by being mounted. In the exemplary embodiment, two trays 521 are disposed in line along the apparatus width direction on the lower part with respect to the transfer unit 30. A medium supply path 52P is formed between each tray 521 and the transfer nip NT as the secondary transfer position using plural transport roll pairs 522, or the like.

A sending roll 523 that sends the uppermost recording medium P which is mounted on the tray 521 is disposed on the upper side of each tray 521. The transport roll pairs 522S on the most upstream side in the transport direction of the recording medium P, among the plural transport rolls 522 functions as a separation roll that separates the recording medium P sheet by sheet, which is sent by being overlapped from the tray 521 using the sending roll 523. In addition, transport roll pairs 522R which is located right upstream of the transfer nip NT in the transport direction of the recording medium P in the plural transport roll pairs 522 is operated so that a movement timing of the toner image on the transfer belt 31 and a transport timing of the recording medium P match.

The medium supply unit 52 is provided with a reserve transport path 52Pr. The reserve transport path 52Pr starts from an opening portion 91W on a side opposite to the second housing 92 side of the first housing 91, and joins a turning portion 52P2 of a medium supply path 52P. The reserve transport path 52Pr is a transport path when sending the recording medium P which is sent out from a recording medium supply unit (not illustrated) which is an option, and is disposed by being adjacent to the opening portion 91W side of the first housing 91 to the image forming unit 12.

The intermediate transport unit 58 is provided with plural transport members 581 that are disposed at a position between the transfer nip NT of the transfer unit 30 and the fixing nip NF of the fixing unit 40, and is provided with an endless transport belt which is wound around a roll. The belt transport member 581 has a mechanism in which a transport belt circulates while causing the recording medium P to be attracted onto the surface of the transport belt, by suctioning (negative pressure suctioning) air from the inside, and the recording medium P is transport.

The medium output unit 54 outputs the recording medium P onto which a toner image is fixed in the fixing unit 40 of the image forming unit 12 to the outside of the housing 90 from a output port 92W which is formed at an end portion of the second housing 92 on a side opposite to the first housing 91 side. The medium output unit 54 is provided with an output medium receiving unit 541 that receives the recording medium P which is output from the output port 92W.

The medium output unit 54 includes a medium output path 54P on which the recording medium P is transported from the fixing unit 40 (fixing nip NF) to the output port 92W. The medium output path 54P includes a belt transport member 543, plural pair of rolls 542, and the like. In addition, a pair of rolls 542E among the plural pair of rolls 542, which is disposed on the most downstream side in the output direction of the recording medium P functions as an output roll for outputting the recording medium P on an output medium receiving unit 541.

The medium returning unit 56 is provided with plural pair of rolls 561. The plural pair of rolls 561 form a reversing path 56P to which the recording medium P that passes through the image inspection unit 66 is sent, in a case in which there is a request for forming an image on both faces. The reverse path 56P includes a branching path 56P1, a transport path 56P2, and a reverse path 56P3. The branching path 56P1 is branched from a medium output path 54P. The transport path 56P2 sends the recording medium P which is received from the branching path 56P1 to the medium supply path 52P. The reverse path 56P3 is provided in the middle of the transport path 56P2, and turns inside out of the recording medium P by turning back (switchback transporting) a transport direction of the recording medium which is transported on the transport path 56P2 toward the opposite direction.

(Post-Processing Unit)

The medium cooling unit 62 and the correcting unit 64 that configure the post-processing unit 60, and the image inspection unit 66 are disposed in this order from the upstream side in the output direction, on the upstream side in the output direction of the recording medium P with respect to a branching portion of the branching path 56P1, on the medium output path 54P of the medium output unit 54.

The medium cooling unit 62 is provided with a heat absorbing unit 621 that absorbs heat of the recording medium P, and a pressing unit 622 that presses the recording medium P to the heat absorbing unit 621. The heat absorbing unit 621 is disposed on the upper side of the medium output path 54P, and the pressing unit 622 is disposed on the lower side of the medium output path 54P.

The heat absorbing unit 621 is provided with an endless heat absorbing belt 6211, plural rolls 6212 that support the heat absorbing belt 6211, a heat sink 6213 which is disposed inside the heat absorbing belt 6211, and a fan 6214 for cooling the heat sink 6213. The heat absorbing belt 6211 is in contact with the recording medium P so as to exchange heat on the outer peripheral face. A roll 6212D in the plural rolls 6212 functions as a driving roll that transmits a driving force to the heat absorbing belt 6211. The heat sink 6213 is caused to be in face-contact with an inner peripheral face of the heat absorbing belt 6211, in a sliding manner, in a determined range which goes along the medium output path 54P.

The pressing unit 622 is provided with an endless pressing belt 6221, and plural rolls 6222 that support the pressing belt 6221. The pressing belt 6221 is wound around the plural rolls 6222. The pressing unit 622 transports the recording medium P along with the heat absorbing belt 6211 while pressing the recording medium P to the heat absorbing belt 6211 (heat sink 6213).

The correcting unit 64 is provided on the downstream side of the medium cooling unit 62 in the medium output unit 54.

The correcting unit 64 corrects bending (curl) of the recording medium P which is received from the medium cooling unit 62. In addition, an optical sensor 661 that configures a main portion of the image inspection unit 66 is disposed on the downstream side of the correcting unit 64 in the medium output unit 54.

The optical sensor 661 is provided with a light source such as a light emitting element (for example, LED), and a light receiving unit such as a light receiving element (for example, PD), and detects a presence or absence of a defect in toner concentration, image, image position, or the like, or a degree thereof, of the fixed toner image, by radiating light to the recording medium P from the light source, and receiving specular reflection light or diffuse reflection light which is reflected from the recording medium P. As will be described later, the optical sensor 661 may be used when measuring an L* value of a white image, or an L* value of a recording medium. A measurement result is output to the controller 70.

<Electrical Configuration of Image Forming Apparatus>

Subsequently, an electrical configuration of the image forming apparatus will be described.

Figure 3:
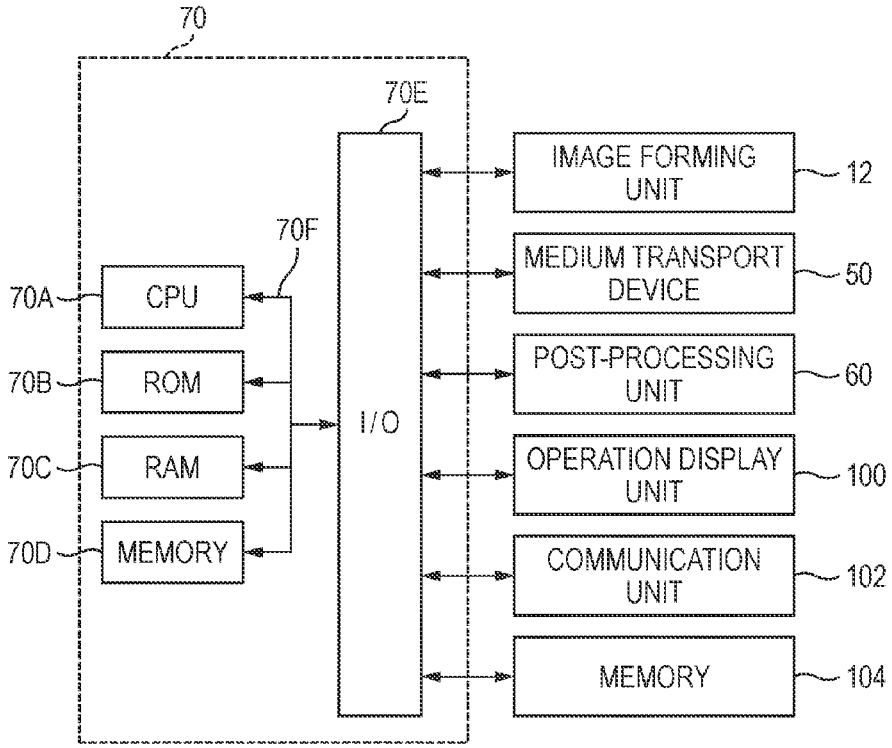
FIG. 3 is a schematic diagram which illustrates an example of an electrical configuration of the image forming apparatus according to the first exemplary embodiment.

FIG. 3 is a schematic diagram which illustrates an example of an electrical configuration of the image forming apparatus according to the first exemplary embodiment. As illustrated in FIG. 3, the controller 70 is configured as a computer that performs a control and various operations of the entire apparatus. That is, the controller 70 is provided with a Central Processing Unit (CPU) 70A, a Read Only Memory (ROM) 70B, a Random Access Memory (RAM) 70C, a non-volatile memory 70D, and an input/output interface (I/O) 70E.

Each of the CPU 70A, the ROM 70B, the RAM 70C, the memory 70D, and the I/O 70E is connected to each other through a bus 70F. The CPU 70A reads a program which is stored in the ROM 70B, and executes the program by setting the RAM 70C to a working area. Each of the image forming unit 12, the medium transport device 50, the post-processing unit 60, the operation display 100, a communication unit 102, and a memory 104 is connected to the I/O 70E of the controller 70. The controller 70 controls each of these units.

The operation display 100 includes various buttons such as a start button, or a numeric keypad, a touch panel, and the like, for displaying various screens such as a setting screen. The operation display 100 receives an operation of a user, and displays various information for the user, using the above described configuration.

The communication unit 102 is an interface for performing a communication with an external device through a communication line which is wired, or wireless. For example, the communication unit functions as an interface for performing a communication with a computer which is connected to a network such as a local area network (LAN). The memory 104 is provided with a storage unit such as a hard disk. The memory 104 stores various data such as log data, a control program, and the like.

Image information may be obtained from an image reader (not illustrated) in the image forming apparatus, and may be obtained from an external device through the communication unit 102. Image forming instruction and selection setting information may be obtained from the operation display 100, and may be obtained from the external device through the communication unit 102. Here, "selection setting information" is information related to image forming conditions which are selected or set by a user.

In the exemplary embodiment, information related to "lightness of recording medium" is included in the selection setting information. In the exemplary embodiment, lightness of a recording medium is denoted by an L* value as an index which denotes lightness in the CIE 1976 L*a*b* color system. When an L* value is close to 100, it becomes a color which is close to white, and when the L* value is low, it becomes a dark color. By denoting lightness of a recording medium using the L* value, an influence on a white image which is formed on a recording medium is appropriately expressed. In addition, in a case of not being designated, particularly, the L* value is a value which is measured using a spectral reflection density meter which is commercially available. In addition, the L* value is an example, and a parameter other than the L* value may be used when denoting lightness of a recording medium.

As will be described later, in the exemplary embodiment, a type, a color, a size, and lightness of a recording medium is associated with a tray that accommodates the recording medium, the tray is selected by a user, and the type, the color, the size, and the lightness of the recording medium is also selected by the user. Accordingly, information related to a type, a color, a size, and lightness of a recording medium is included in the selection setting information. The selection setting information may include other information related to image forming conditions such as a page, the number of copies, the number of pages for image forming on one sheet of recording medium, and a margin.

<Image Forming Operation>

Subsequently, an image forming process and a process of post-processing which are performed with respect to the recording medium P using the image forming apparatus 10 will be described. The image forming process is performed based on various image forming conditions which are selected and set by a user. In the exemplary embodiment, a "normal mode" in which an image is formed on a recording medium using white toner and colored toner, and a "white mode" in which a white base layer is formed on a recording medium using white toner, and a color image is formed on the white base layer using colored toner are prepared for the image forming process.

(White Toner and Colored Toner)

White toner is formed by containing a white pigment, a binder resin, and various additives. Colored toner of each color of yellow (Y), magenta (M), cyan (C), and black (K) is formed by including a pigment of each color, a binder resin, and various additives. In addition, a nonwhite color means a color which is not transparent, or not white. The toner is used as a developer by being combined with a carrier.

Each of white toner and colored toner may be set so as to have a center particle diameter in a range of 3 μm or more and 9 μm or less, and a specific weight in a range of 1 or more and 1.7 or less. For example, white toner with a center particle diameter of 6 μm, and a specific weight of 1.4 may be used. In the exemplary embodiment, an L* value of a white image is adjusted so as to be a target value or more, by forming a white image using TMA corresponding to an L* value of a recording medium. Setting of TMA corresponding as an L* value of a recording medium will be described later.

TMA (Toner Mass per Area) represents a mass of toner per unit area ($g/m^2$) in a toner image transferred to a recording medium P. The TMA is a value which may be obtained by suctioning toner of a predetermined sized patch and measuring the mass of the suctioned toner before fixing the toner image on the recording medium P.

(Recording Medium)

In the image forming apparatus, plural recording mediums of which a type, a size, or the like, is different are used. In the exemplary embodiment, the image forming apparatus 10 is provided with two trays 521 in which recording mediums P are accommodated by being mounted (refer to FIG. 1). Recording mediums of which L* values are different may be accommodated in the two trays 521. An L* value of a recording medium which is accommodated in the tray 521 is set and registered in each tray 521 by a user.

Figures 4, 5:
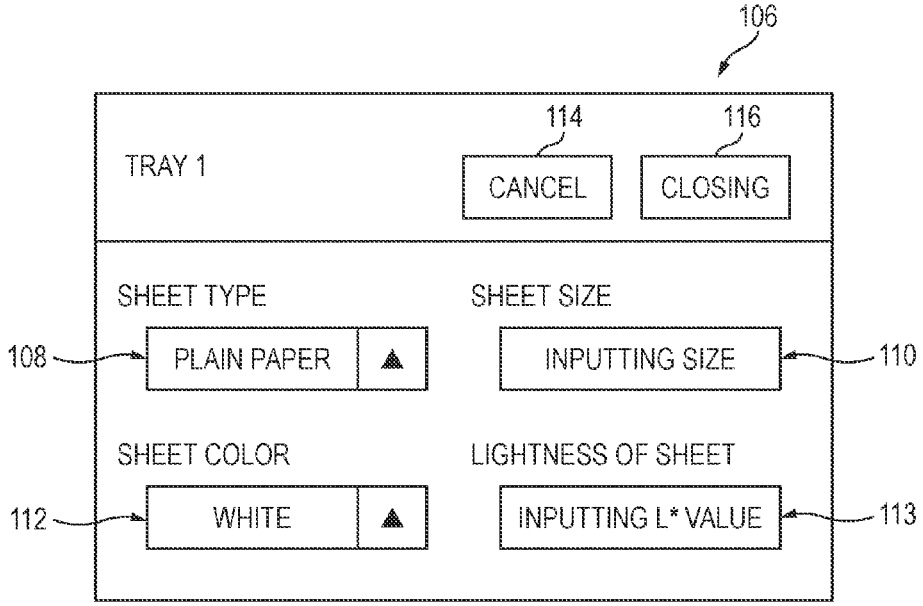
FIG. 4 is a schematic diagram which illustrates an example of a setting screen which is displayed on an operation display.
FIG. 5 is a table which illustrates an example of a relationship between a tray and attributes of a recording medium.

Hereinafter, the two trays 521 are referred to as "trays 1 and 2". In addition, a recording medium is referred to as a "sheet". FIG. 4 is a schematic diagram which illustrates an example of a setting screen which is displayed on the operation display. As illustrated in FIG. 4, a setting screen 106 for setting a type, a color, a size, and lightness of a sheet is displayed on the operation display 100. The illustrated example is a setting screen for the "tray 1".

The setting screen 106 includes a setting unit 108 that selects and sets a type of a sheet such as a plain paper, coated paper, and recycled paper, an input unit 110 that inputs a sheet size, a setting unit 112 that selects and sets a sheet color such as white, pink, light blue, and black, an input unit 113 that inputs an L* value as lightness of a sheet, a cancel button 114, and a closing button 116. A user sets a type, a color, a size, and lightness of a sheet, by operating the setting screen 106 with respect to the tray 1. Similarly, a type, a color, a size, and lightness of a sheet are also set with respect to the tray 2.

A user may set a type, a color, a size, and lightness of a sheet based on information which is incidental to a recording medium. In addition, for lightness of a sheet, a value obtained by being measured using a colorimeter located in the outside of the apparatus may be set, or a value obtained from image information which is read in the image reader (not illustrated) in the inside of the image forming apparatus may be set.

A relationship between a tray which is set and a type, a color, a size, and lightness of a sheet is stored in the memory 70D of the controller 70 in a form of a table illustrated in FIG. 5, for example. Accordingly, a type, a color, a size, and lightness of a sheet are also selected, when a user selects a tray. That is, a type, a color, a size, and lightness (L* value) of a recording medium are selected when selecting a tray.

(Mode Selecting Process)

Subsequently, a mode selecting process will be described.

Figure 6:
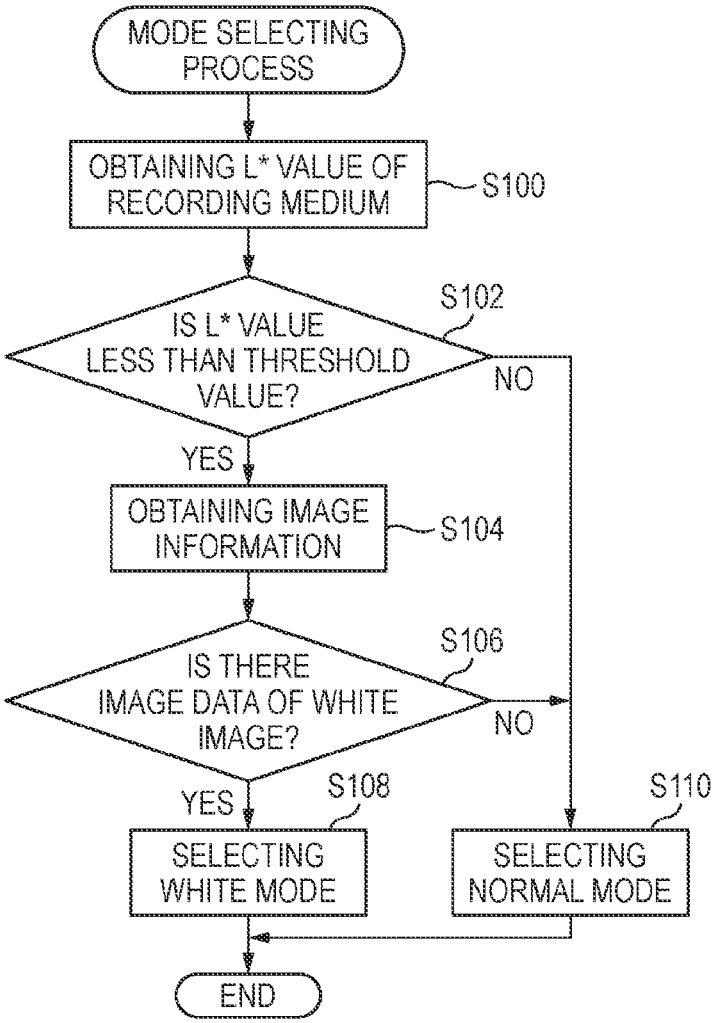
FIG. 6 is a flowchart which illustrates an example of a procedure of a mode selecting process.

In the exemplary embodiment, a mode selecting process in which any one of a normal mode and a white mode is selected is executed before the image forming process. FIG. 6 is a flowchart which illustrates an example of a procedure of the mode selecting process. The mode selecting process is executed by the CPU 70A of the controller 70.

The mode selecting process is started when the controller 70 receives an image forming instruction, selection setting information, and image information from a user. In addition, a user also selects a type, a color, a size, and lightness (L* value) of a recording medium by selecting a tray, when giving an image forming instruction. The controller 70 also receives the selection setting information along with the image forming instruction.

First, an L* value of a recording medium is obtained in step 100, and whether or not the L* value of the recording medium is less than a threshold value is determined in step 102. Since it becomes a color which is close to a white color when the L* value is close to 100, whether or not an L* value of a recording medium is less than 90 may be determined by setting the threshold value as 90, for example. In a case in which the L* value is less than the threshold value, the process proceeds to step 104. In a case in which the L* value is the threshold value or more, the process proceeds to step 110, and a normal mode is selected.

Subsequently, image information is obtained in step 104, and whether or not image data of a white image is included is determined in step 106. In a case of including the image data of the white image, the process proceeds to step 108, and a white mode is selected. Here, in a case of not including the image data of the white image, the process proceeds to step 110, and a normal mode is selected.

In a case in which an L* value of a recording medium is less than the threshold value, and image information includes the image data of the white image, the "white mode" in which a white base layer is formed on a recording medium using white toner, and a color image is formed on the white base layer using colored toner is selected, using the above described mode selecting process. In addition, in a case in which the "white mode" is not selected, the "normal mode" is selected. The controller 70 gives an image forming instruction according to a selected mode. In addition, the condition that an L* value of a recording medium should be less than the threshold value may be excluded.

(White Base Layer)

In the "white mode", a white image is formed on a recording medium as a base layer, and a color image is formed on the white image as the base layer, using colored toner. For example, in a colored recording medium, it is possible to avoid a change in hue in a case of forming a color image, by forming a white image as a base layer. In addition, it is possible to reuse a recording medium on which an image is already formed as a white recording medium, by overwriting a white image on the image which is already formed. However, as illustrated in FIGS. 7A to 7D, there is a case in which lightness (L* value) of a recording medium has influences on the image which is formed on the recording medium.

Figure 7A:
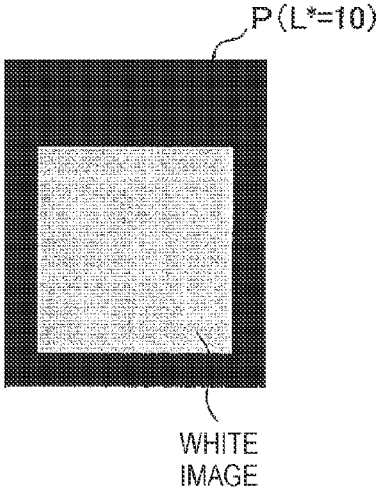
FIGS. 7A to 7D are schematic diagrams for describing an effect of lightness of a recording medium on an image which is formed on the recording medium.
Figure 7B:
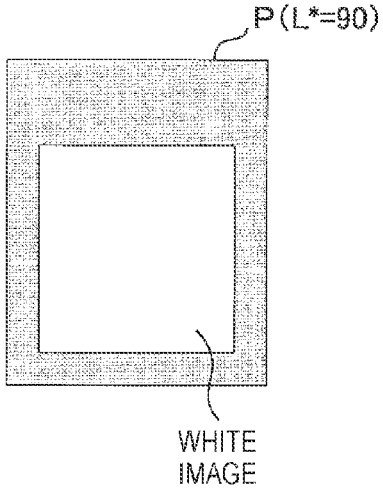

In the example illustrated in FIG. 7A, an L* value of a recording medium P is 10, and is low. Meanwhile, in the example illustrated in FIG. 7B, an L* value of a recording medium P is 90, and is high. As illustrated in FIGS. 7A and 7B, even when a white image is formed using the same TMA, the L* value of the white image which is formed on the recording medium P with the low L* value of 10 is lower than the L* value of the white image which is formed on the recording medium P with the high L* value of 90.

Figure 7C:
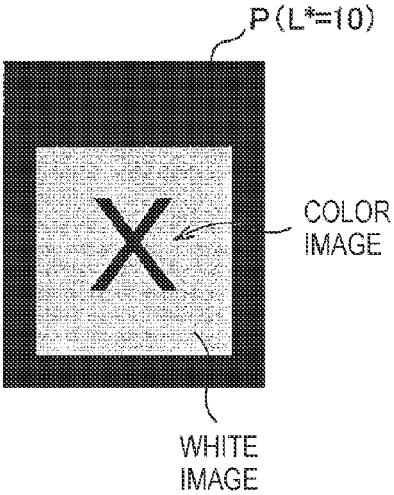
Figure 7D:
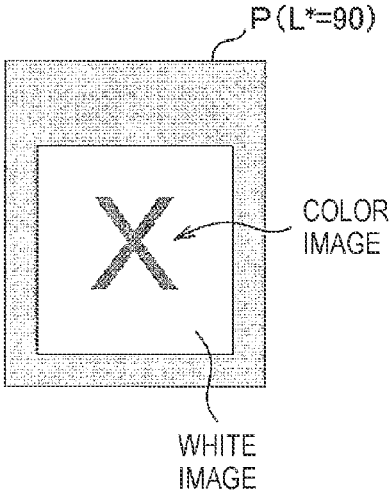

In the example illustrated in FIG. 7C, a color image is formed on a white image with a low L* value. Meanwhile, in the example illustrated in FIG. 7D, the same color image is formed on a white image with a high L* value using the same color, and the same TMA as the color image which is illustrated in FIG. 7C. As illustrated in FIGS. 7C and 7D, even when the same color image is formed, using the same TMA, hue is different between a color image which is formed on a white image with a low L* value and a color image which is formed on a white image with a high L* value. For example, a red image which is formed on a white image with a low L* value has a dark red color compared to a red image which is formed on a white image with a high L* value.

Therefore, in the exemplary embodiment, when performing the "white mode", an L* value of a white image which is formed as a base layer on a recording medium is set as a predetermined target value, by setting TMA according to an L* value of a recording medium. In this manner, it is possible to reduce unevenness of an L* value of a white image which is formed as a base layer, and stabilize hue of a color image which is formed on the white image.

(Normal Mode)

Figure 8:
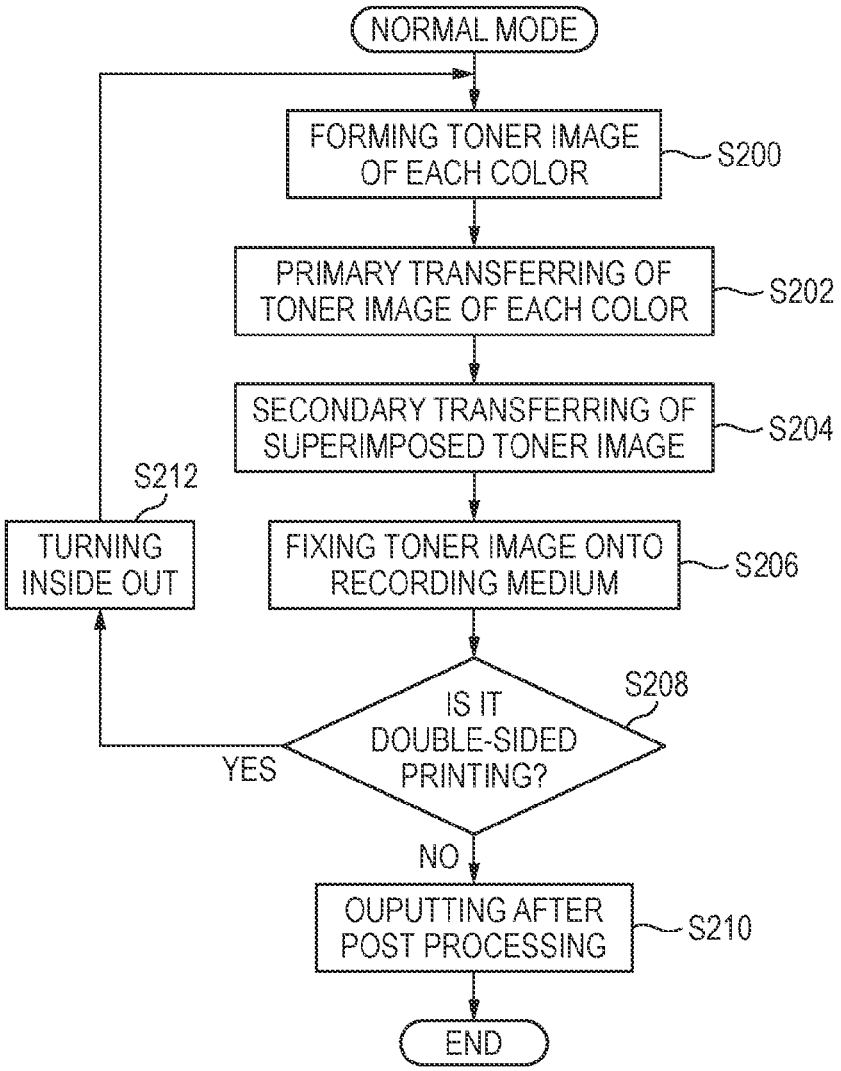
FIG. 8 is a flowchart which illustrates an example of a procedure of an image forming process in a normal mode.

FIG. 8 is a flowchart which illustrates an example of a procedure of an image forming process in the "normal mode". An image forming process and a post-processing process in the "normal mode" will be described with reference to FIGS. 1 and 2, as well. The controller 70 which receives an image forming instruction in the "normal mode" causes the image forming unit 12 (toner image forming unit 20, transfer unit 30, and fixing unit 40), the medium transport device 50, the post-processing unit 60, and the like, to be operated. For example, the photoconductor drum 21 of the image forming unit 14 of each color, and a developing roll 242 of the developing unit 24 are rotated, and the transfer belt 31 is circulated. In addition, the pressure roll 42 is rotated, and the fixing belt 411 is circulated.

First, in step 200, each unit of the image forming unit 12 and the medium transport device 50 are instructed so as to form a toner image of each color. A toner image of a corresponding color of white (V), a spot color (W), yellow (Y), magenta (M), cyan (C), and black (K) is formed on the photoconductor drum 21 of each color. Specifically, the photoconductor drum 21 is charged by the charging unit 22, is exposed by exposure light L according to image data of a corresponding color, using the exposure unit 23, and an electrostatic latent image is formed on the surface. The electrostatic latent image which is formed on the photoconductor drum 21 is developed by a developer of a corresponding color which is supplied from the developing unit 24. In this manner, a toner image of a corresponding color is formed on the photoconductor drum 21 of each color.

Subsequently, in step 202, each unit of the image forming unit 12 and the medium transport device 50 are instructed so that toner images of each color are primarily transferred. The toner images of each color which are formed on the photoconductor drum 21 of each color are sequentially transferred to the transfer belt 31 which is circulating by being applied with a transfer bias voltage through the primary transfer roll 33 of each color. In this manner, a superimposed toner image in which toner images of six colors are superimposed is formed on the transfer belt 31. In the exemplary embodiment, toner images of six colors are superimposed in order of the W color, the Y color, the M color, the C color, the K color, and the white color from the transfer belt 31 side. The superimposed toner image is transported to the transfer nip NT due to a circulation of the transfer belt 31.

Subsequently, in step 204, each unit of the image forming unit 12 and the medium transport device 50 is instructed so that the superimposed toner image is secondarily transferred. In the transfer nip NT, the recording medium P is supplied by the transport roll pairs 522R of the medium supply unit 52 at a timing of transporting the superimposed toner image. The superimposed toner image is transferred to the recording medium P from the transfer belt 31 when the transfer bias voltage is applied in the transfer nip NT. The toner images of six colors are superimposed in order of the white color, the K color, the C color, the M color, the Y color, and the W color from the recording medium P side after transferring.

Subsequently, in step 206, each unit of the image forming unit 12 and the medium transport device 50 is instructed so that the toner image on the recording medium P is fixed. The recording medium P onto which the superimposed toner image is transferred is transported toward the fixing nip NF of the fixing unit 40 using the intermediate transport unit 58. The fixing unit 40 applies heat and a pressure to the recording medium P that passes through the fixing nip NF. In this manner, the toner image which is transferred onto the recording medium P is fixed.

Subsequently, in step 208, whether or not duplex printing is instructed is determined. In a case in which duplex printing is not instructed, the process proceeds to step 210. In step 210, each unit of the post-processing unit 60 and the medium transport device 50 is instructed so as to output the recording medium P after performing post-processing, and the routine is finished.

The recording medium P which is output from the fixing unit 40 is subjected to a process using the post-processing unit 60 while being transported toward the output medium receiving unit 541 in the outside of the apparatus, using the medium output unit 54. The recording medium P which is heated in the fixing process is firstly cooled in the medium cooling unit 62. Subsequently, bending of the recording medium P is corrected by the correcting unit 64. In addition, in the toner image which is fixed onto the recording medium P, a presence or absence of a defect in toner concentration, image, image position, or the like, or a degree thereof is detected by the image inspection unit 66. In addition, the recording medium P is output to the medium output unit 54.

Meanwhile, in a case in which duplex printing is instructed, the process proceeds to step 212. In step 212, each unit of the medium transport device 50 is instructed so that the recording medium P is turned inside out, and is returned to the medium supply path 52P.

In a case in which an image is formed on a face of the recording medium P on which an image is not formed (case of duplex printing), the controller 70 switches a transport path of the recording medium P after passing through the image inspection unit 66 from the medium output path 54P of the medium output unit 54 to the branching path 56P1 of the medium returning unit 56. In this manner, the recording medium P passes through the reverse path 56P, and is sent to the medium supply path 52P by being turned inside out. An image is formed (fixed) on the rear face of the recording medium P through the same process as the above described image forming process on the front face. The recording medium P is output to the output medium receiving unit 541 in the outside of the apparatus, using the medium output unit 54, through the same process as a treatment process after the above described image forming process on the front face.

In addition, the process returns to step 200, the processes from step 200 to step 210 are executed, and the routine is finished. In addition, in step 208, it is determined that "there is no instruction on duplex printing".

(White Mode)

Figure 9:
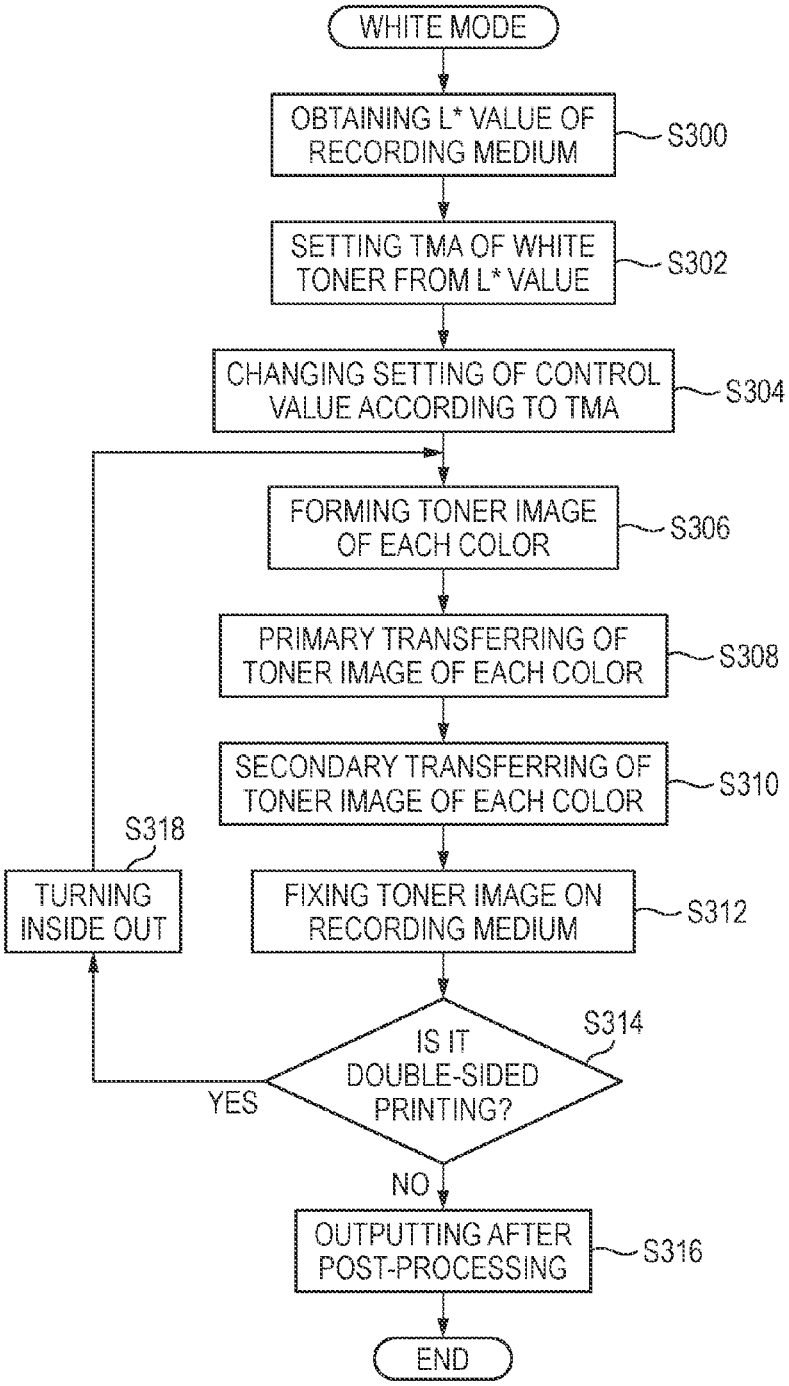
FIG. 9 is a flowchart which illustrates an example of a procedure of an image forming process in a white mode.

FIG. 9 is a flowchart which illustrates an example of a procedure of an image forming process in the "white mode". The image forming process in the "white mode" will be described with reference to FIGS. 1 and 2, as well. In the first exemplary embodiment, the example in which an L* value of a recording medium which is set by a user through the operation display 100 is used will be described. In addition, descriptions of the post-processing process or the process for duplex printing will be simplified, since the process is the same as that in the normal mode. In the exemplary embodiment, since a white image is formed as a base layer, a white solid image is formed in the entire image forming region of a recording medium, since the white image is formed as a base layer.

The controller 70 that receives an image forming instruction in the "white mode" causes the toner image forming unit 20, the transfer unit 30, the fixing unit 40, the medium transport device 50, the post-processing unit 60, and the like, to be operated, similarly to the case of the normal mode.

First, in step 300, an L* value of a recording medium is obtained. As described above, an L* value of a recording medium P which is accommodated in the tray 521 is set and registered by a user in each tray 521. Accordingly, when the tray 521 is selected, an L* value of a recording medium that forms a white image is also selected and set, and is stored. Here, an L* value of a recording medium which is stored is read and used. For example, when the tray 2 is selected in the example illustrated in FIG. 5, an L* value of a recording medium is 20.

Subsequently, in step 302, TMA is set from the L* value of the recording medium. In the exemplary embodiment, as denoted in Table 1 below, a relationship between an L* value (target value) of a white image and TMA when forming a white image with the L* value is stored in advance in a form of a table, in each range of a different L* value of the recording medium. Accordingly, TMA is set according to an L* value of a recording medium, and an L* value (target value) of a white image with reference to a relationship in Table 1 below.

TABLE 1

| | | L* value of white image | | | | |
|---|---|---|---|---|---|---|
| | | 70 | 75 | 80 | 85 | 90 |
| L* value | 10 to 30 | 10.0 | 11.7 | 13.3 | 15.0 | 16.7 |
| of | 30 to 50 | 6.7 | 8.0 | 8.8 | 11.0 | 15.4 |
| recoding | 50 to 70 | 3.3 | 4.0 | 4.4 | 7.0 | 14.2 |
| medium | 70 to 90 | 0 | 0 | 0 | 3.0 | 13.0 |

In the Table 1, L* values of a recording medium is divided into four different ranges of "10 to 30", "30 to 50", "50 to 70", and "70 to 90". Here, "X to Y" means X or more and less than Y. There are five L* values (target values) of a white image of "70", "75", "80", "85", and "90". For example, in a case in which an L* value of a recording medium is in a range of "30 to 50", and an L* value (target values) of a white image is "80", TMA is set as "8.8".

There is a case in which an L* value of a recording medium is not limited to be constant in the recording medium, and varies according to a measuring position, measuring conditions, and the like. In the exemplary embodiment, since L* values of a recording medium are caused to correspond to TMA by being divided into four ranges, there is no problem of a variation in L* value of a recording medium, compared to a case in which the L* value of the recording medium and TMA are set to one-to-one correspondence.

Subsequently, in step 304, a control value in image forming conditions using the image forming unit 12 is changed, in order to execute set TMA. For example, a control value in a potential control or a transfer current control when forming a white toner image is changed according to the set TMA. By changing a control value, a white image is formed using the set TMA.

Subsequently, in step 306, each unit of the image forming unit 12 and the medium transport device 50 is instructed so as to form a toner image of each color. Similarly to the normal mode, a toner image of a corresponding color is formed on the photoconductor drum 21 of each color.

Subsequently, in step 308, each unit of the image forming unit 12 and the medium transport device 50 is instructed so that toner image of each color is primarily transferred. Similarly to the normal mode, a superimposed toner image in which toner images of six colors are superimposed is formed on the transfer belt 31. In the exemplary embodiment, toner images of six colors are superimposed in order of the W color, the Y color, the M color, the C color, the K color, and the white color from the transfer belt 31 side. The superimposed toner image is transported to the transfer nip NT due to a circulation of the transfer belt 31.

Subsequently, in step 310, each unit of the image forming unit 12 and the medium transport device 50 is instructed so that the superimposed toner image is secondarily transferred. Similarly to the normal mode, the superimposed toner image is transferred to the recording medium P from the transfer belt 31, when a transfer bias voltage is applied in the transfer nip NT. Toner images of six colors are superimposed in order of the white color, the K color, the C color, the M color, the Y color, and the W color from the recording medium P side after transferring.

Subsequently, in step 312, each unit of the image forming unit 12 and the medium transport device 50 is instructed so that the toner images on the recording medium are fixed. The recording medium P onto which the toner image of each color is transferred is transported toward the fixing nip NF of the fixing unit 40 using the intermediate transport unit 58. The fixing unit 40 applies heat and a pressure to the recording medium P that passes through the fixing nip NF. In this manner, the toner image transferred to the recording medium P is fixed.

Subsequently, in step 314, whether or not duplex printing is instructed is determined. In a case in which duplex printing is not instructed, the process proceeds to step 316. In step 316, each unit of the post-processing unit 60 and the medium transport device 50 is instructed so that the recording medium P is output after performing the post-processing, and the routine is finished.

The recording medium P which is output from the fixing unit 40 is subjected to a process using the post-processing unit 60 while being transported toward the output medium receiving unit 541 in the outside of the apparatus, using the medium output unit 54. In addition, the recording medium P is output to the medium output unit 54.

Meanwhile, in a case in which duplex printing is instructed, the process proceeds to step 318. In step 318, each unit of the medium transport device 50 is instructed so that the recording medium P is returned to the medium supply path 52P by being turned inside out. In addition, the process returns to step 306, processes from step 306 to step 316 are executed, and the routine is finished. In step 314, it is determined that "there is no instruction on duplex printing".

Due to the above described operations, a white image is formed on the recording medium as a base layer, and a color image is formed on the white image which is the base layer, using colored toner. Since TMA when forming the white image is set according to an L* value of the recording medium so that an L* value (target value) of the white image is obtained, the L* value of the white image formed on the recording medium becomes the target value. In addition, hue of the color image formed on the white image is stabilized, by forming the white image as the base layer.

In the exemplary embodiment, since an L* value of a recording medium which is set by a user is used, it is easy to obtain an L* value of a recording medium. In addition, in the exemplary embodiment, since a relationship among an L* value of a recording medium, an L* value of a white image (target value), and TMA is applied in advance, a set value of TMA is easily obtained from the L* value of the recording medium and the L* value (target value) of the white image.

In the above descriptions, in order to make obtaining of TMA easy, the example in which a relationship among an L* value of a recording medium, an L* value (target value) of a white image, and TMA is stored in a table is described; however, a relationship between an L* value (target value) of a white image and TMA may be provided by using an expression, in each different range of an L* value of a recording medium.

For example, when TMA is set as "x", and an L* value (target value) of a white image is set as "y", a relationship of xy in a case in which an L* value of a recording medium is "10 to 30" is provided in the following expression (1), and a relationship of xy in a case in which an L* value of a recording medium is "70 to 90" is provided in the following expression (2).

$$y=3x+40 \quad \text{Expression (1)}$$

$$y=0.5x+83.5 \quad \text{Expression (2)}$$

Second Exemplary Embodiment

Figure 10:
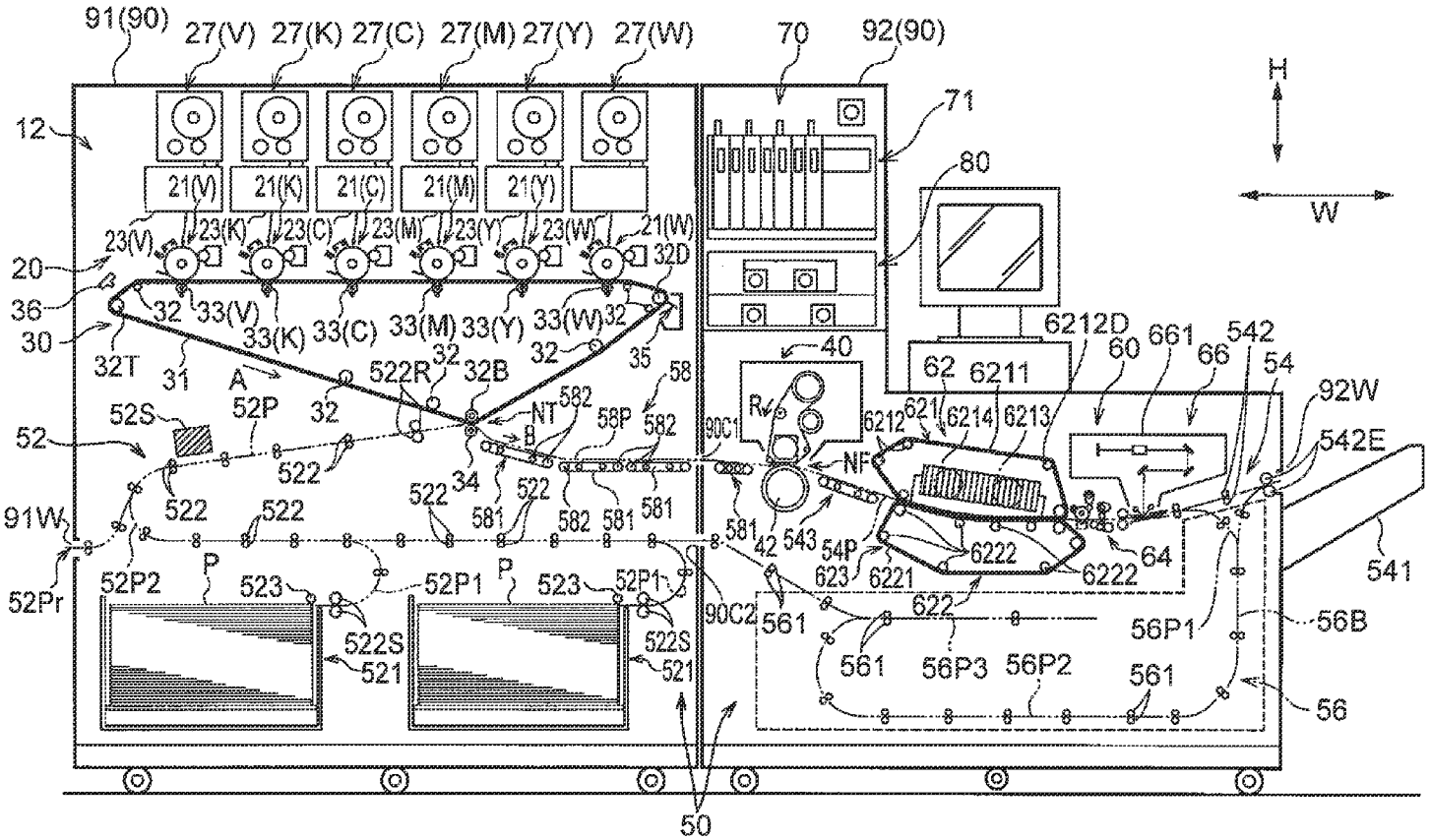
FIG. 10 is a schematic diagram which illustrates an example of a configuration of an image forming unit (main portion) according to a second exemplary embodiment.

FIG. 10 is a schematic diagram which illustrates an example of a configuration of an image forming unit (main portion) according to a second exemplary embodiment. In the first exemplary embodiment, the example in which an L* value of a recording medium which is set by a user is used is described; however, in the second exemplary embodiment, as illustrated in FIG. 10, an optical sensor 52S is provided on the medium supply path 52P of the medium supply unit 52, and an L* value of a recording medium P is directly detected by the optical sensor 52S. An L* value of a recording medium is accurately obtained by the optical sensor 52S.

Since an image forming apparatus in the exemplary embodiment has the same configuration as that in the first exemplary embodiment except for the optical sensor 52S which is provided, the same reference numerals are given, and descriptions thereof will be omitted. In addition, since operations of the image forming apparatus are the same as those in the first exemplary embodiment except for the fact that an L* value (detecting value) of a recording medium P is obtained from the optical sensor 52S, and only a white image is formed in an image forming process in a "white mode", descriptions thereof will be omitted. In a case in which only a white image as a base layer is formed, so-called "additional printing" in which a color image is formed on a recording medium which is once output is performed.

The optical sensor 52S is provided with a light source and a light receiving unit, similarly to the optical sensor 661, and detects an L* value of a recording medium by radiating light to a recording medium P from the light source, and receiving specular reflection light or diffuse reflection light which is reflected from the recording medium P.

Third Exemplary Embodiment

In the first exemplary embodiment, the example in which an L* value of a recording medium which is set by a user is used is described; however, in a third exemplary embodiment, a white image which is tested by a predetermined TMA is formed, and an L* value of a recording medium is estimated from predetermined TMA, and an L* value (measured value) of the white image which is formed. Even in a case of a recording medium of which an L* value is not clear, an L* value of the recording medium is estimated.

Since a configuration of the image forming apparatus is the same as that in the image forming apparatus in the first exemplary embodiment, descriptions thereof will be omitted. In addition, since operations of the image forming apparatus are the same as those in the first exemplary embodiment except for the fact that an "estimating process of an L* value of a recording medium" is executed before an image forming process in a "white mode", and only a white image is formed, descriptions will be omitted except for the "estimating process of an L* value of a recording medium".

Figure 11:
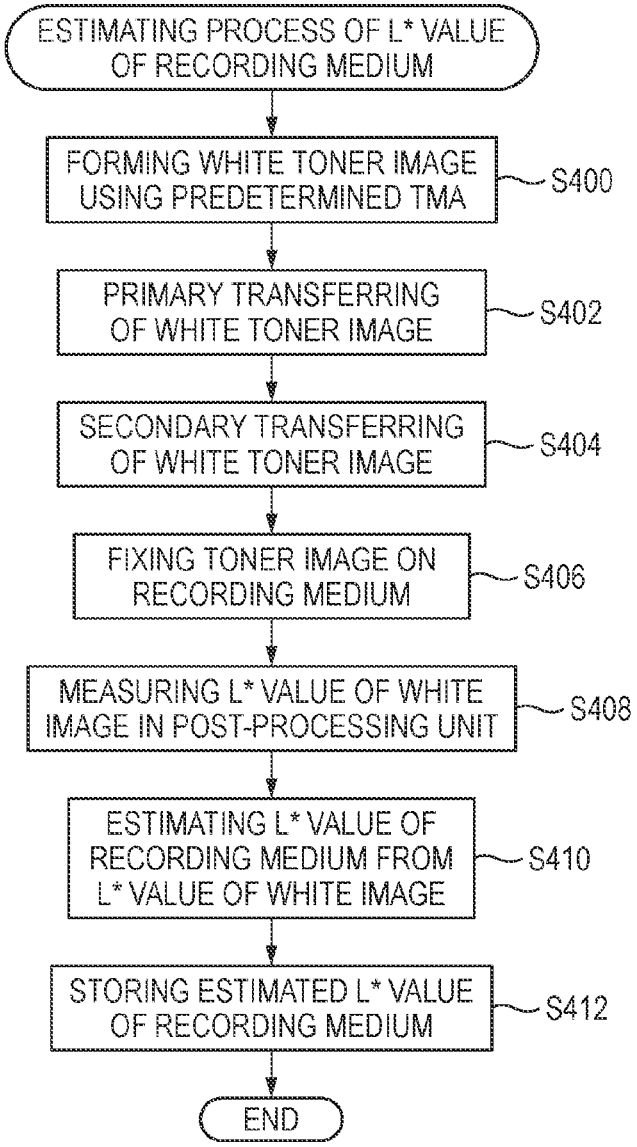
FIG. 11 is a flowchart which illustrates an example of a procedure of an "estimating process of an L* value of a recording medium" which is performed prior to an image forming process in a third exemplary embodiment.

FIG. 11 is a flowchart which illustrates an example of a procedure of the "estimating process of an L* value of a recording medium" which is executed before the image forming process in the third exemplary embodiment. The process is started when executing of the "estimating process of an L* value of a recording medium" is instructed from a user through the operation display 100.

First, in step 400, each unit of the image forming unit 12 and the medium transport device 50 is instructed so as to form a white toner image using predetermined TMA. A toner image of white toner is formed on a photoconductor drum 21V, using a toner image forming unit 20V for white color (V).

Subsequently, in step 402, each unit of the image forming unit 12 and the medium transport device 50 is instructed so that the white toner image is primarily transferred. The white toner image which is formed on the photoconductor drum 21V is transferred to a transfer belt 31V that circulates, by being applied with a transfer bias voltage through a primary transfer roll 33V.

Subsequently, in step 404, each unit of the image forming unit 12 and the medium transport device 50 is instructed so that the white toner image is secondarily transferred. The toner image is transferred to the recording medium P from the transfer belt 31. Subsequently, in step 406, each unit of the image forming unit 12 and the medium transport device 50 is instructed so that the toner image on the recording medium is fixed. The fixing unit 40 applies heat and a pressure to the recording medium P that passes through the fixing nip NF, and the white toner image which is transferred to the recording medium P is fixed.

Subsequently, in step 408, each unit of the post-processing unit 60 and the medium transport device 50 is instructed so as to measure an L* value of the white image which is formed on the recording medium P. The L* value of the white image is measured by the optical sensor 661 of the post-processing unit 60, and the L* value (measured value) of the white image is obtained.

Subsequently, in step 410, the L* value of the recording medium is estimated from the predetermined TMA and the L* value (measured value) of the white image. In addition, in step 412, the estimated L* value of the recording medium is stored, and the routine is finished. Subsequently, when the image forming process in the "white mode" is performed, the L* value (estimated value) of the recording medium is read and used. Alternatively, the L* value (estimated value) of the recording medium may be displayed to a user, and the user who saw the value may set the value personally.

Here, an example of an estimating method of an L* value of a recording medium will be described. As in the Table 1, a relationship among an L* value of a recording medium, an L* value (target value) of a white image, and TMA is stored in a table, and an L* value (estimated value) of the recording medium is obtained from the predetermined TMA and the L* value (measured value) of white image.

For example, when setting a predetermined TMA as "8", an L* value (estimated value) of a recording medium is in a range of 10 to 30, in a case in which an L* value (measured value) of a white image is less than 70 from the above Table 1. Similarly, an L* value (estimated value) of a recording medium is in a range of 30 to 50, in a case in which an L* value (estimated value) of a white image is 70 or more and less than 75. An L* value (estimated value) of a recording medium is in a range of 50 to 70, in a case in which an L* value (measured value) of a white image is 75 or more and less than 80. An L* value (estimated value) of a recording medium is in a range of 70 to 90, in a case in which an L* value (measured value) of a white image is 80 or more.

Fourth Exemplary Embodiment

In the first exemplary embodiment, the example in which an image forming process of one recording medium is performed is described; however, in the fourth exemplary embodiment, a feedback control in which resetting of TMA is repeated until an L* value of a white image on a recording medium reaches a target value is performed, on the premise that image forming is performed on plural recording mediums. In this case, an L* value of a white image which is actually formed becomes a target value or more, reliably.

Since a configuration of the image forming apparatus is the same as that in the first exemplary embodiment, descriptions thereof will be omitted. In addition, since operations of the image forming apparatus are the same as those in the first exemplary embodiment except for an image forming process in which only a white image is formed in the "white mode", descriptions thereof will be omitted.

Figure 12:
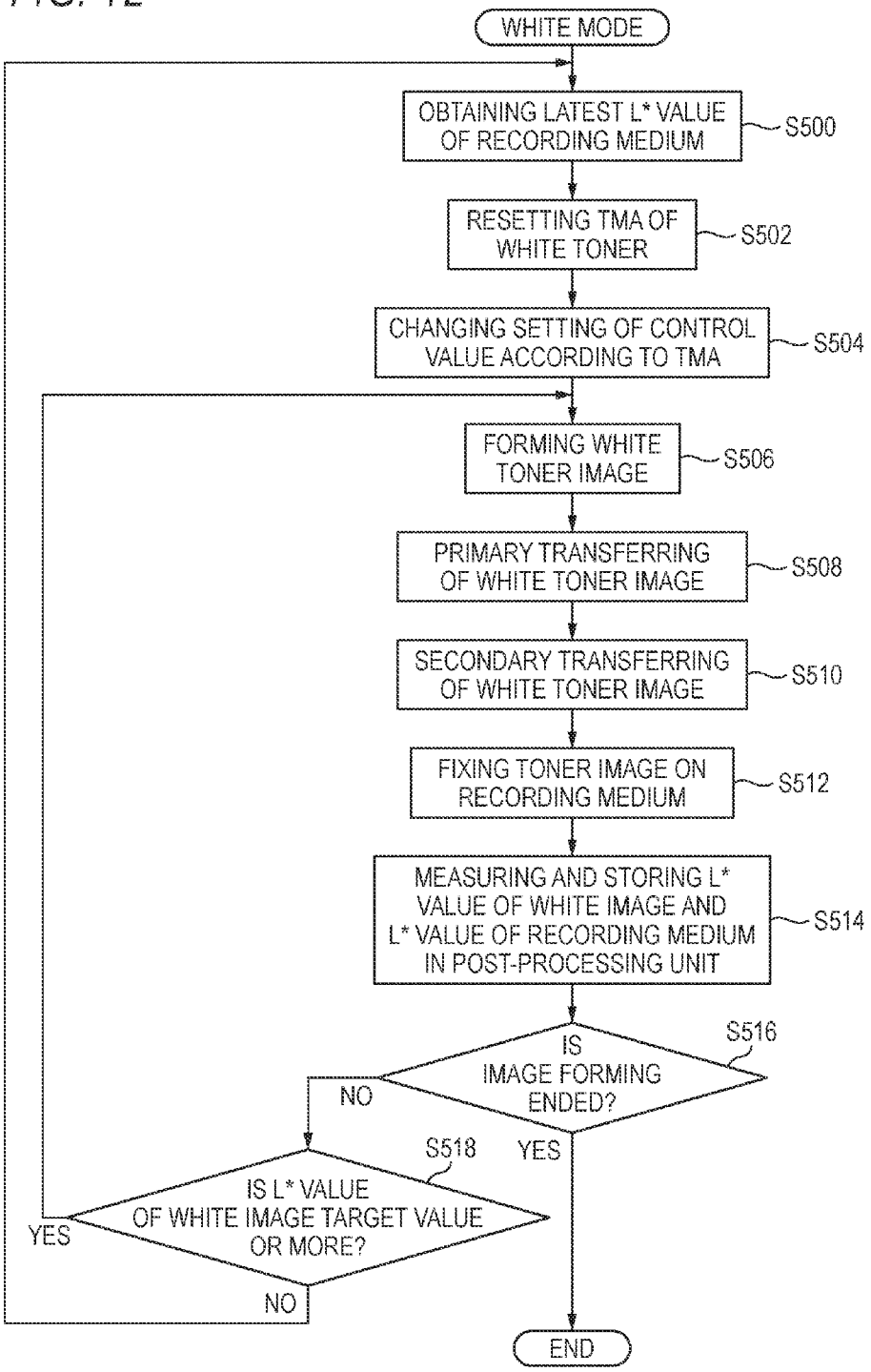
FIG. 12 is a flowchart which illustrates an example of a procedure of an image forming process in a white mode in a fourth exemplary embodiment.

FIG. 12 is a flowchart which illustrates an example of a procedure of an image forming process in a white mode in the fourth exemplary embodiment. First, in step 500, the latest L* value of a recording medium is obtained. Subsequently, in step 502, TMA of a white toner is set. In the exemplary embodiment, similarly to the first exemplary embodiment, first, TMA corresponding to an L* value of a recording medium, and an L* value (target value) of a white image is set. In addition, in a case in which the L* value (measured value) of the white image does not reach a target value, a set value of TMA is stepwisely increased, regardless of the L* value (measured value) of the recording medium. For example, TMA is increased by +0.5.

Subsequently, in step 504, a control value in image forming conditions using the image forming unit 12 is changed, in order to execute the set TMA. Due to the change of the control value, a white image is formed, using the set TMA.

Subsequently, in step 506, each unit of the image forming unit 12 and the medium transport device 50 is instructed so as to form a white toner image using the set TMA. The white toner image is formed on the photoconductor drum 21V using the toner image forming unit 20V for white color (V).

Subsequently, in step 508, each unit of the image forming unit 12 and the medium transport device 50 is instructed so that the white toner image is primarily transferred. The white toner image formed on the photoconductor drum 21V is transferred to the transfer belt 31V that circulates, by being applied with a transfer bias voltage through the primary transfer roll 33V.

Subsequently, in step 510, each unit of the image forming unit 12 and the medium transport device 50 is instructed so that the white toner image is secondarily transferred. The toner image is transferred to the recording medium P from the transfer belt 31. Subsequently, in step 512, each unit of the image forming unit 12 and the medium transport device 50 is instructed so that the toner image on the recording medium is fixed. The fixing unit 40 applies heat and a pressure to the recording medium P that passes through the fixing nip NF, and the white toner image which is transferred onto the recording medium P is fixed.

Subsequently, in step 514, each unit of the post-processing unit 60 and the medium transport device 50 is instructed so as to measure an L* value of the white image formed on the recording medium P, and an L* value of the recording medium P. The L* value of the white image and the L* value of the recording medium are measured by the optical sensor 661 of the post-processing unit 60, and the obtained L* value (measured value) of the white image, and the L* value (measured value) of the recording medium are stored.

Subsequently, whether or not image forming is finished is determined in step 516. In a case in which image forming is finished, the routine is finished. In a case in which image forming is not finished, the process proceeds to step 518, and whether or not the L* value (measured value) of the white image is the target value or more is determined.

In a case in which the L* value (measured value) of the white image is the target value or more, the process returns to step 506, and processes in step 506 to step 518 are repeated, since it is not necessary to reset TMA this time. In a case in which the L* value (measured value) of the white image is less than the target value, the process returns to step 500, and processes in step 500 to step 518 are repeated, since it is necessary to reset TMA.

That is, whether or not an L* value (measured value) of a white image is a target value or more is determined every time, until image forming is finished, and in a case in which the L* value (measured value) of the white image is less than the target value, TMA is reset by increasing thereof. In this manner, an L* value (measured value) of a white image is maintained at the target value.

Since an L* value (measured value) of a recording medium is also obtained every time, the latest L* value of a recording medium is obtained when resetting TMA, and in a case in which an L* value of a recording medium is remarkably changed, TMA corresponding to an L* value of a recording medium and an L* value (target value) of a white image may be set, similarly to the first exemplary embodiment.

MODIFICATION EXAMPLE

The configuration of the image forming apparatus which is described in the above exemplary embodiment is merely an example, and it is needless to say that the configuration may be changed without departing from the scope of the invention.

In the above described exemplary embodiment, a tandem-type image forming apparatus is described; however, in the image forming process in the "white mode", the white image may be formed using a white toner amount per unit area which is set according to lightness of a recording medium, and it may be a so-called rotary-type image forming apparatus in which a rotating body on which plural developing units are mounted is rotated, and developing is performed by causing developing units of plural colors to face, or come into contact with a photoconductor, sequentially.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a controller comprising an input/output interface, the controller performing various operations of the image processing apparatus and being configured to act as a setting unit that sets a white toner amount per unit area corresponding to a lightness of a recording medium on which a white image is to be formed using white toner; and an image forming unit electrically connected to the input/output interface forms the white image using the white toner amount per unit area set by the setting unit, and forms a color image using colored toner, wherein the setting unit executes a feedback control which sets the white toner amount per unit area so as to correspond to a plurality of lightness ranges of a plurality of recording mediums, respectively, wherein the feedback control comprises forming a white toner image on a recording medium, fixing the white toner image to the recording medium, measuring a lightness value of the fixed white toner image and a lightness value of the recording medium, and increasing the white toner amount per unit area if the lightness value of the fixed white image is less than a target lightness value.

2. The image forming apparatus according to claim 1, wherein the lower the lightness of the recording medium on which the white image is to be formed, the larger the white toner amount per unit area set by the setting unit.

3. The image forming apparatus according to claim 2, wherein the setting unit sets the white toner amount per unit area so as to correspond to the lightness of the white image, which is set based on the recording medium, to be formed to a predetermined target value.

4. The image forming apparatus according to claim 3, further comprising:

a tray associated with at least a type of the recording medium, a color of the recording medium, a size of the recording medium, and the lightness of a recording medium, wherein the setting unit obtains the lightness of the recording medium which is correlated with a tray of the recording medium by user, from the tray which is selected when forming the white image.

5. The image forming apparatus according to claim 2, further comprising:

a tray associated with at least a type of the recording medium, a color of the recording medium, a size of the recording medium, and the lightness of a recording medium, wherein the setting unit obtains the lightness of the recording medium which is correlated with a tray of the recording medium by user, from the tray which is selected when forming the white image.

6. The image forming apparatus according to claim 1, wherein the setting unit sets the white toner amount per unit area so as to correspond to the lightness of the white image, which is set based on the recording medium, to be formed to a predetermined target value.

7. The image forming apparatus according to claim 6, further comprising:

a tray associated with at least a type of the recording medium, a color of the recording medium, a size of the recording medium, and the lightness of a recording medium, wherein the setting unit obtains the lightness of the recording medium which is correlated with a tray of the recording medium by user, from the tray which is selected when forming the white image.

8. The image forming apparatus according to claim 1, further comprising:

a tray associated with at least a type of the recording medium, a color of the recording medium, a size of the recording medium, and the lightness of a recording medium, wherein the setting unit obtains the lightness of the recording medium which is correlated with a tray of the recording medium by user, from the tray which is selected when forming the white image.

9. The image forming apparatus according to claim 1, wherein the lightness is an L* value which denotes the lightness in an L*a*b* color system.

10. A non-transitory computer readable medium storing a program causing a computer to execute a process for forming an image, the process comprising:

setting a white toner amount per unit area corresponding to a lightness of a recording medium on which a white image is to be formed using white toner; and forming the white image using the white toner amount per unit area, and forming a color image using colored toner, wherein the computer executes a feedback control which sets the white toner amount per unit area so as to correspond to a plurality of lightness ranges of a plurality of recording mediums, respectively, wherein the feedback control comprises forming a white toner image on a recording medium, fixing the white toner image to the recording medium, measuring a lightness value of the fixed white toner image and a lightness value of the recording medium, and increasing the white toner amount per unit area if the lightness value of the fixed white image is less than a target lightness value.

* * * * *